United States Patent [19]

Sand

[11] 4,097,720

[45] Jun. 27, 1978

[54] BASEBOARD HEATER

[75] Inventor: Robert H. Sand, Canton, Conn.

[73] Assignee: The Vulcan Radiator Company, South Windsor, Conn.

[21] Appl. No.: 657,099

[22] Filed: Feb. 11, 1976

[51] Int. Cl.[2] ..... F24H 9/08

[52] U.S. Cl. ..... 219/366; 52/290; 165/53; 165/129; 219/368; 219/374; 219/375

[58] Field of Search ..... 219/365, 366, 357, 342, 219/367, 368, 374, 520, 536; 165/53, 54, 55, 56, 57, 129; 174/48; 237/79; 52/290, 287, 27

[56] References Cited

U.S. PATENT DOCUMENTS

| | | | |
|---|---|---|---|
| 2,662,747 | 12/1953 | Trane et al. | 165/55 |
| 2,993,978 | 7/1961 | Markel et al. | 219/365 |
| 3,051,816 | 8/1962 | Knoll | 219/365 |
| 3,165,624 | 1/1965 | Cunningham | 219/365 |
| 3,367,412 | 2/1968 | Hagensick et al. | 165/56 |
| 3,543,003 | 11/1970 | Dincher et al. | 219/366 |
| 3,566,077 | 2/1971 | Steiner | 219/365 |
| 3,566,077 | 2/1971 | Steiner | 219/365 |
| 3,596,058 | 7/1971 | Steiner | 219/367 |
| 3,627,984 | 12/1971 | Bollinger | 219/365 |

FOREIGN PATENT DOCUMENTS

| | | | |
|---|---|---|---|
| 418,485 | 2/1967 | Switzerland | 219/365 |
| 1,138,375 | 11/1969 | United Kingdom | 219/366 |

*Primary Examiner*—Arthur T. Grimley

*Assistant Examiner*—Bernard Roskoski

*Attorney, Agent, or Firm*—McCormick, Paulding & Huber

[57] ABSTRACT

An extruded back panel is adapted to be mounted to a wall so as to extend horizontally and in closely spaced relationship to the floor. The panel has integrally formed channels for slidably receiving projecting flanges provided for this purpose on longitudinally spaced support brackets located intermediate the end portions of the elongated heating element, or on utility boxes provided at either end of the elongated heating element. Each bracket is slotted to receive the elongated heating element intermediate the end portions of said element. The back panel defines a conduit channel which communicates with the utility boxes. Two versions of a front panel or enclosure are described, one of which provides for a top grille portion to be integrally formed with the front panel, and the other has a separate top grille portion connected to one or more of the underlying support brackets and to a rearwardly projecting flange on the front panel itself. The version with the front panel defining the top grille portion is U-shaped and also includes a lower opening defining leg along the lower edge of the front panel. The rear marginal portion of the lower leg of the U defines a depending flange received in the lower channel of the back panel.

11 Claims, 7 Drawing Figures

BASEBOARD HEATER

SUMMARY OF THE INVENTION

This invention relates generally to enclosures for baseboard heaters or the like, and deals more particularly with two versions of an enclosure which is especially easy to assemble and is particularly useful for accommodating an elongated electrical heating element and associated wiring.

The principal aim of the present invention is to provide a baseboard heater enclosure characterized by component parts which are easily fitted together for assembling an enclosure which not only supports the heating element, but which also provides an architecturally pleasing enclosure for such heating element.

In carrying out the foregoing aim of the present invention, apparatus is provided for supporting and housing an elongated heat exchange element, particularly of the electrical finned type, said apparatus including an elongated back panel extrusion preferably fabricated from aluminum or the like. The back panel member has a generally flat rear face which is adapted to abut a vertically extending wall, and a front face which defines upper and lower integrally formed channels extending the entire length of the panel. A forwardly opened conduit channel is defined between these upper and lower flanges by forwardly projecting vertically spaced legs which have facing slots adapted to slidably receive a cover plate for the conduit channel. Electrical wiring can thereby be conveniently accommodated in the conduit channel, and access to the conduit is rendered convenient by the sliding cover plate. In one version of the invention support brackets are provided for the heating element in longitudinally spaced locations along the back panel, each bracket having an upwardly open slot for receiving the finned heat exchange element, and each bracket further including upper and lower flanges, projecting portions of which flanges are slidably received in the upper and lower channels of the back panel. An electrical utility box is conveniently mounted in the same upper and lower back panel channels, and two such boxes are preferably provided, one at either end of the enclosure to support the elongated heating element. Top and bottom walls of each utility box have projecting flanges received in the vertically spaced back panel channels. A front panel is mounted to the forward edges of the support brackets, and also serves to cover the open front side of the utility boxes. A vane-type grille member is provided in the top of the enclosure, the grille member being supported at its rear edge in a slot provided for this purpose in the back panel. The grille member is held in place at its front edge by a single screw associated with each of the support brackets, and said screw also serves to hold the front panel in place.

In a second or alternative version of the present invention the utility boxes themselves support the heating element from either end, and one or more support brackets provided intermediate the utility boxes for supporting the heating element and a U-shaped front panel. In this version of the invention, the front panel member is provided with rearwardly projecting upper and lower legs, the lower leg of the U having a downturned flange adjacent its rearmost edge. This flange is received in the upwardly open lower channel provided for this purpose in the back panel member. The upper leg of the U-shaped front panel has openings provided therein and integrally formed vanes to control the flow of heated air. Thus the grille is integrally formed in the front panel. The utility boxes in this version of the enclosure have top and bottom walls, and left and right hand side walls, with the front panel covering the open portion of the box to provide a convenient enclosure well suited to use in connecting the electrical lead lines to the heating element. The top wall of the utility box has an upwardly projecting flange which is received in the upper channel of the back panel member, and an upwardly projecting flange at the front edge of the box serves to support the U-shaped front panel member. A single screw is provided to anchor the front panel member to the left and right hand utility boxes. The support bracket is provided intermediate the left and right hand utility boxes, and such support bracket has projecting flanges which cooperate with portions of the extruded back and front panel members in order to provide a convenient assembly well-suited to easy assembly.

DETAILED DESCRIPTION OF FIRST EMBODIMENT ILLUSTRATED IN FIGS. 1-4 INCLUSIVELY

Figure 1:
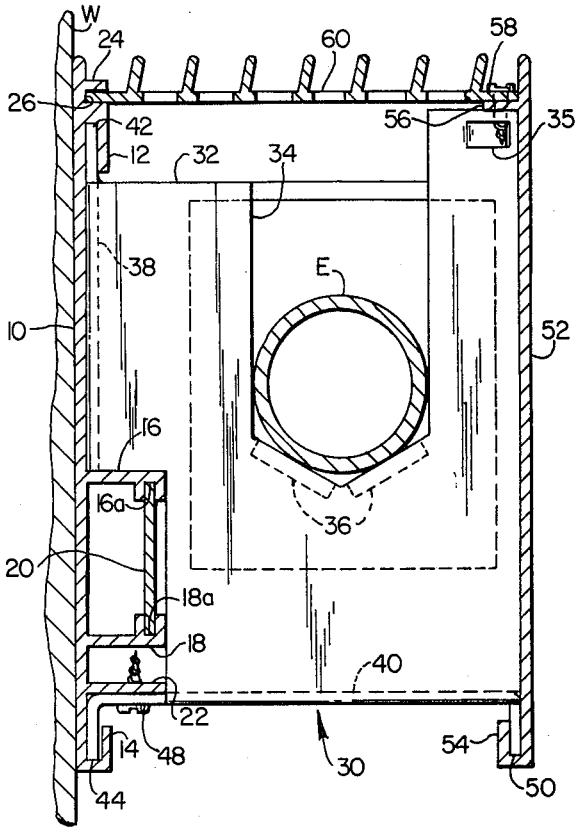
FIG. 1 is a vertical sectinal view on line 1—1 of FIG. 2 through an assembled baseboard heater enclosure of the present invention showing the relationship of the various components with respect to a wall W.

Turning now to FIGS. 1-4 of the drawings in greater detail, FIG. 1 shows the extruded back panel member 10 as having a generally flat rear face adapted for conventional mounting to a wall W by suitable means (not shown), and having a front face which defines upper and lower integrally formed L-shaped flanges, 12 and 14 respectively, the upper flange 12 defining a downwardly open channel, and the lower L-shaped flange 14 defining an upwardly open channel. These vertically spaced channels in the panel 10 slidably receive projecting tang portions of a support bracket 30 best shown in FIG. 3, and projecting flanges of a utility box best illustrated in FIG. 4.

Figure 2:
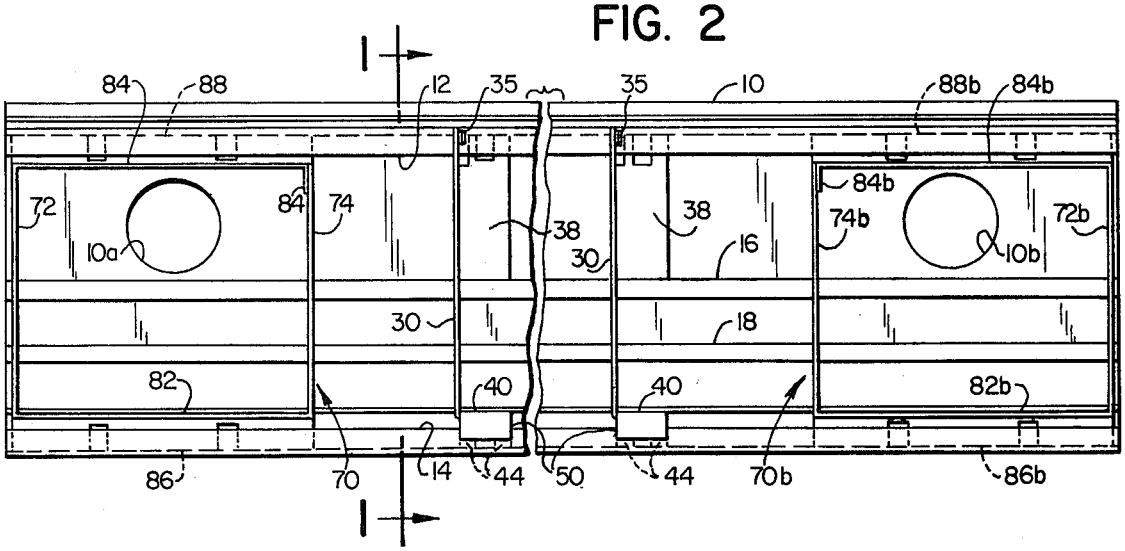
FIG. 2 is an elevational front view of the FIG. 1 enclosure, but with the front panel and the heating element omitted.

Still with reference to the extruded back panel 10, FIG. 2 shows the panel 10 as comprising an elongated extruded member having the above-mentioned L-shaped flanges 12 and 14 integrally formed therein and extending the entire length thereof. In addition, the back panel member 10 further includes integrally formed forwardly projecting legs, 16 and 18, which also extend the entire length of the panel, and which cooperate to define a conduit channel therebetween. More particularly, and by reference to FIGS. 1 and 3 the upper leg 16 includes depending projections defining a slot 16*a* which slots is aligned with a slot 18*a* defined by projections on the lower leg 18 such that a cover plate 20 can be inserted with its marginal upper and lower edges located in the slots 16*a* and 18*a* respectively. The closed conduit channel so defined contains and protects the wiring in accordance with requirements of most electrical codes and the like.

Figure 3:
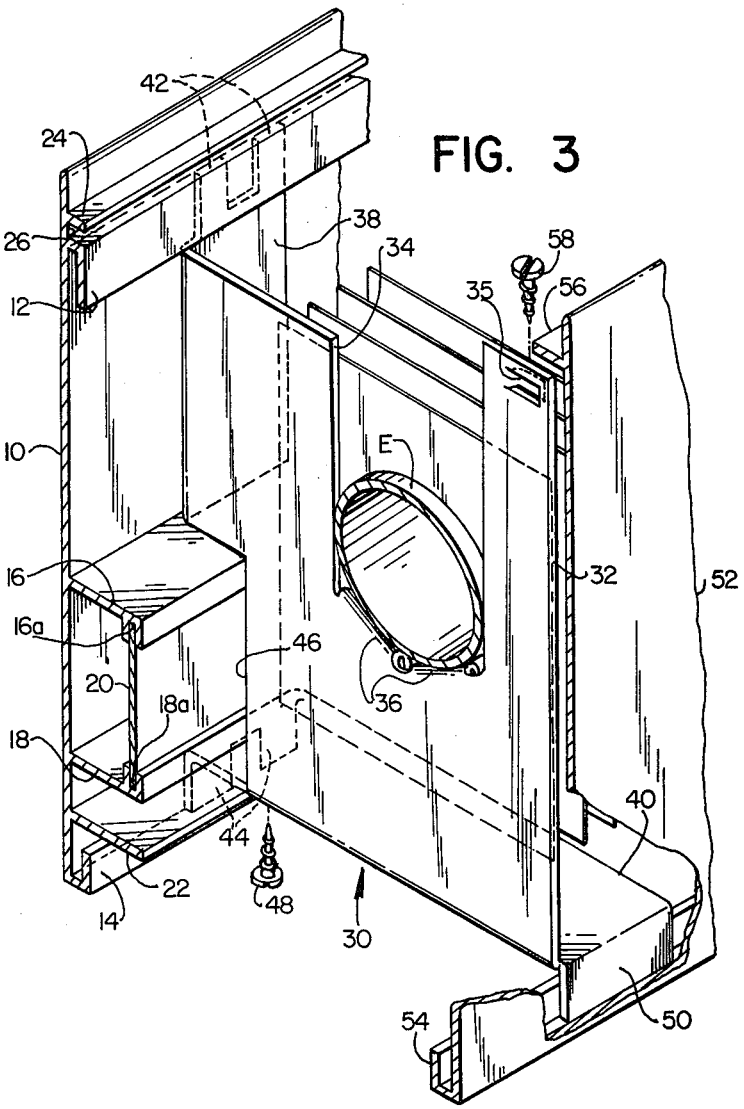
FIG. 3 is a perspective view illustrating the relationship between one of the various support brackets shown in FIG. 2 with respect to the extruded back panel, and with respect to the broken away front panel.

Still with reference to the extruded back panel member 10, a projecting flange 22 is provided intermediate the lower L-shaped flange 14 and the lower leg 18 associated with the electrical conduit referred to previously, said bottom flange 22 being provided for conveniently mounting the support brackets 30, 30 thereto, said support brackets being described hereinbelow in greater detail with reference to FIG. 3. An upper flange 24 is also provided immediately above the upper L-shaped flange 12 in the back panel member 10, and cooperates with the flange 12 to define a slot 26 for receiving the rear edge of a vaned grille defining member 60. As best shown in FIG. 3, and as also shown in FIG. 2, the back panel member 10 is of extruded configuration, having a cross sectional shape which is constant throughout its length, and it is noted that certain features of this cross sectional shape comprise essential elements of the invention disclosed herein.

Turning next to a detailed description of the support bracket 30, as best shown in FIG. 3, each such bracket 30 has a generally vertically extending web portion 32 oriented perpendicularly to the back panel 10 and each such web portion 32 defines an upwardly open slot 34 in which the finned heat exchange element is adapted to be received. The lower sides of the slot 34 may be rolled as best shown in FIG. 3 at 36, 36 so as to conveniently support the elongated heating element E.

Each bracket 30 further includes upper and lower flanges, 38 and 40 respectively, which flanges are bent out of the plane of the web 32 generally at right angles thereto. The upper flange 38 is oriented in a generally vertical plane, that is parallel the plane of the back panel 10, and the lower flange 40 is oriented horizontally, that is a plane oriented perpendicularly with respect to the back panel member 10. The said upper flange 38 of support bracket 30 defines upwardly projecting tangs 42, 42 which tangs are adapted to be slidably received in the upper channel defined by the upper L-shaped flange 12 of the back panel member 10. Tangs 44, 44 may be defined on the lower flange 40 of the bracket 30 said tangs being bent out of the horizontal plane of the flange 40 so as to also be oriented in a vertical plane, and thereby conveniently received in the channel defined by the lower L-shaped flange 14 of the back panel 10. Thus, the tangs 42 and 44 associated with the support bracket 30 are arranged in vertically spaced relationship to one another and conveniently support the bracket 30 from the back panel 10 and thereby rigidly support the elongated heating element indicated generally by reference letter E.

Still with reference to the support bracket 30, and as best shown in FIG. 3 the upper flange 38 has a lower edge located just above the upper leg 16 of the back panel member 10, and the web portion 32 of the support bracket 30 is relieved, or cut away as indicated generally at 46, in order to accommodate the conduit defining channel provided by the legs 16 and 18 of the back panel member 10. Actually, the relieved portion 46 extends downwardly to also accommodate the flange 22 of the panel member 10. The lower flange 40 of support bracket 30 extends rearwardly below the flange 22 as shown. A screw 48 is conveniently inserted through a drilled opening provided for this purpose in the lower flange 40 and threadably received in the bottom flange 22 so as to securely anchor the support bracket 30 at the desired longitudinally spaced location.

The support bracket 30 also includes a depending tang 50 provided at the front edge of the lower flange 40 of said support bracket in order to receive a channel defining L-flange 54 defined at the lower front edge of a front panel 52. The upper portion of the front panel 52 is conveniently mounted to the support bracket 30 as a result of a rearwardly extending flange 56 provided adjacent the upper marginal edge of the front panel 52, which flange 56 has an opening adapted to receive a screw 58 best shown in FIG. 1, said screw also serving to hold the grille 60 in place, and threadably received in an opening defined by an upset portion 35 of the support bracket web 32. Thus, the single screw fastener 58 is adapted to conveniently secure the elongated front panel 52 and the grille 60 to each of the support brackets 30, which brackets are provided in longitudinally spaced relationship along the back panel as suggested in FIG. 2.

Figure 4:
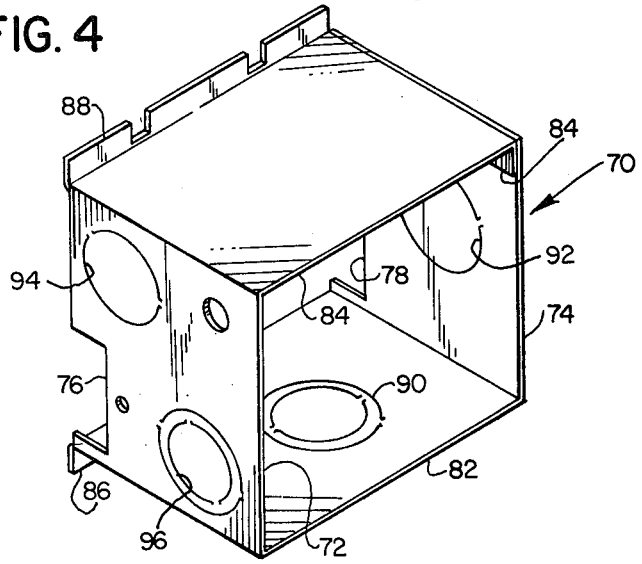
FIG. 4 is a perspective view of one of the utility boxes, of the two shown at opposite ends of the FIG. 2 baseboard heater enclosure.

Still with reference to FIG. 2, electric utility boxes 70, 70*b* are provided adjacent the end portions of the elongated baseboard heating enclosure, one such outlet box 70 being illustrated in greater detail in FIG. 4. The fins of the elongated heating element E illustrated in FIG. 1 terminate just short of the outlet boxes 70, 70*b* in FIG. 2, and these boxes provide a convenient junction point for connecting the power supply lines through openings such as shown at 10*a* and 10*b*, or for connecting these wires (not shown) from the electrical conduit defined by the back plate 10, with the conventional lead wires (not shown) associated with the heating element E. It is an important feature of the present invention that each of the boxes 70, 70*b* can be conveniently assembled with the back plate member 10, and the box 70 includes left and right hand side walls, 72 and 74 respectively, which side walls are under cut or relieved along their rear edges, as indicated generally at, 76 and 78 respectively, in order to accommodate the legs, 16 and 18, as well as to accommodate the lowermost flange 22 of the back plate member 10.

Still with reference to the utility box 70 illustrated in FIG. 4, said box can be seen to be generally rectangular in configuration with an open front side and an open rear side which sides are closed as a result of the location for the box, the rear side being closed by the back panel member 10, and the front side being closed by the front panel member 52. The top and bottom walls, 80 and 82 respectively, of the box 70 are integrally connected to the left and right hand side walls 72 and 74 along at least one side edge thereof. More particularly, the box 70 may be fabricated from an initially flat piece of sheet metal or the like with an weldment being provided in the area indicated generally at 84 at the upper right hand corner of the box 70.

In order to provide a convenient means for mounting the box 70 to the back panel 10, the upper and lower walls, 82 and 84, respectively, are provided with upper and lower integrally formed flanges 86 and 88 respectively, which flanges are adapted to being slidably received in the channels defined by the upper and lower L-shaped flanges, 12 and 14 respectively, in the back member 10. Knock-out openings may be provided for in the outlet box 70, and their locations may be generally as illustrated in FIG. 4, with one such opening being indicated generally at 90 in the bottom wall 82 and other openings 92, 94 and 96 being provided for in the left and right hand side walls as well.

It will be apparent that the boxes 70, 70b as well as the support brackets 30, 30 can be conveniently assembled with the back panel member 10 in the field, and without the necessity for skilled mechanical sheet metal bending expertise. This feature of the present invention permits the components of the baseboard heating enclosure described herein to be conveniently assembled in the field by electrical tradesmen or the like. It is only the locating of the screws 48 and 58 which anchor the support brackets 30, 30 with reference to the other components of the present device which require any degree of mechanical skill. Providing the support brackets 30, 30 and outlet boxes 70, 70*b* so that they can be conveniently slid into place on the back panel 10 permits the entire assembly to be readily put together in the field with minimal mechanical expertise.

Although the baseboard heater enclosure structure is particularly well suited to supporting an electrical heating element and housing the associated wiring and electrical hook-up circuitry, it will also be apparent that a heated fluid conduit of the finned tube type might also be supported in the brackets 30, 30.

Figure 5:
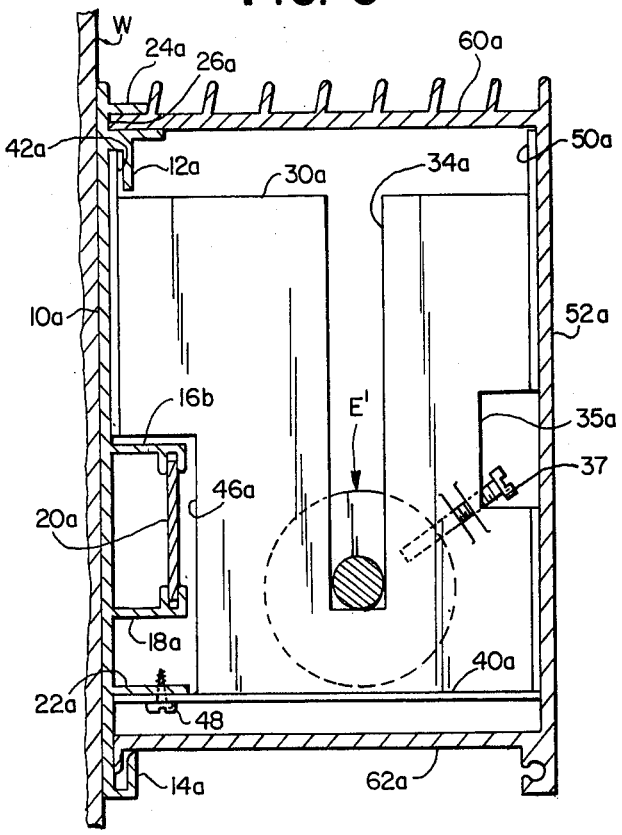
FIG. 5 is a vertical sectional view through an alternative version of baseboard heater enclosure constructed in accordance with the present invention showing the relationship of the various components with respect to a wall W.
Figure 7:
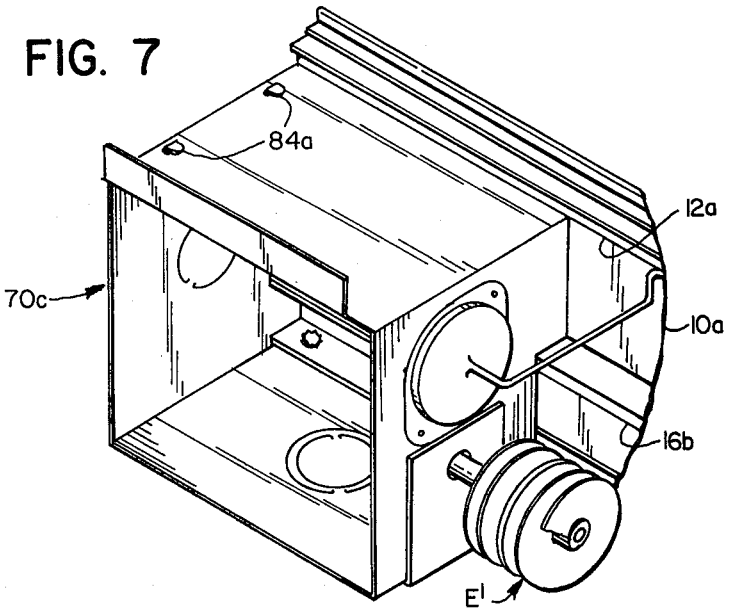
FIG. 7 is a perspective view of one of the utility boxes, and more particularly the left hand utility box provided at the opposite end of the FIG. 6 baseboard heater enclosure.
Figure 6:
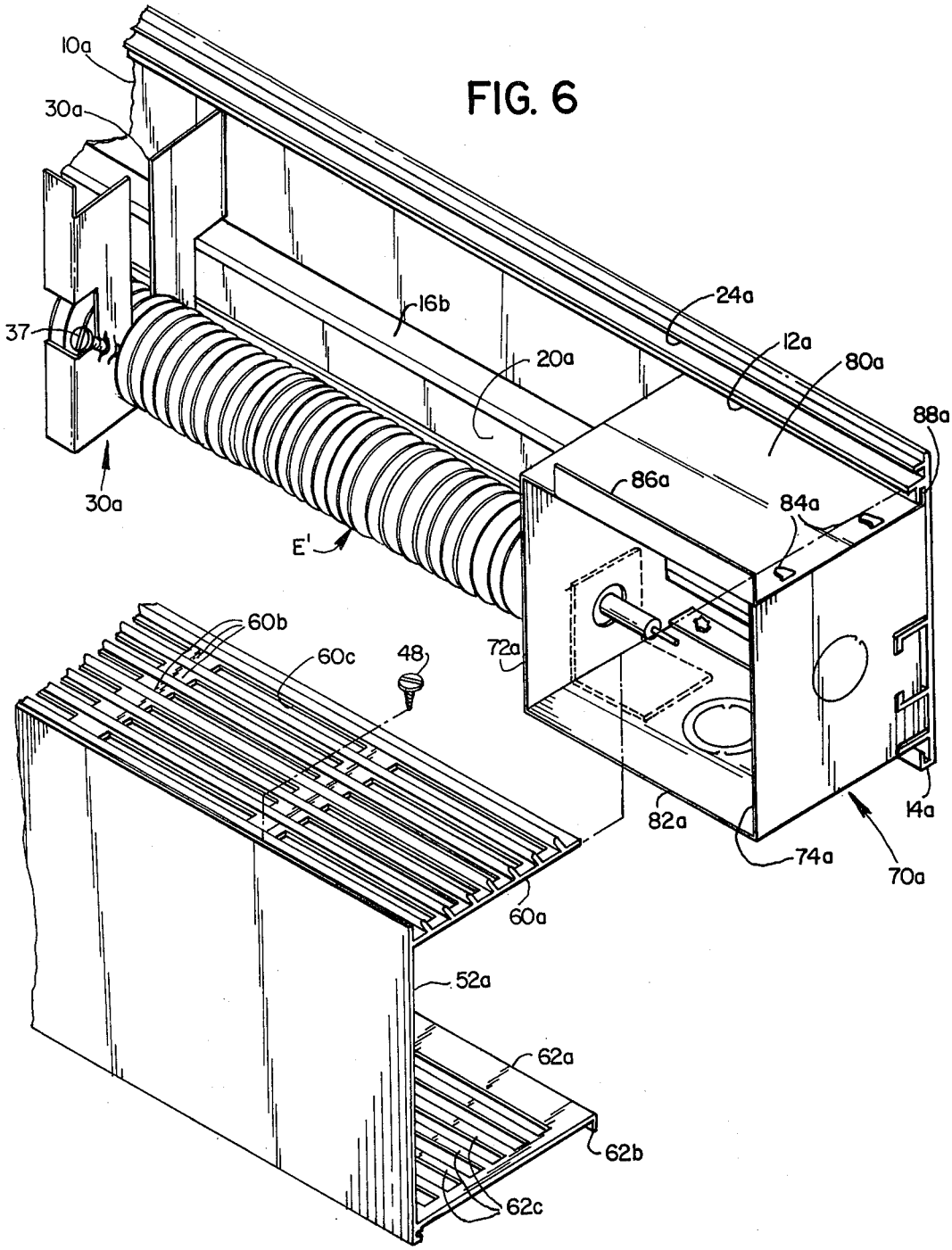
FIG. 6 is a perspective view with portions being shown in exploded relationship of the assembled baseboard heater enclosure of FIG. 5, portions being broken away to better reveal the cooperation of the various components.

DETAILED DESCRIPTION OF THE ALTERNATIVE EMBODIMENT ILLUSTRATIVE IN FIGS. 5–7 INCLUSIVELY

Turning now to FIGS. 5, 6 and 7 inclusively, an alternative embodiment of the present invention is there shown, and more particularly, FIG. 5 shows an alternative embodiment as including an extruded back panel member 10*a* adapted for being conventionally mounted to a wall W by suitable means (not shown). The back panel member 10 has a front face which defines upper and lower integrally formed L-shaped flanges 12*a* and 14*a* respectively, the upper flange 12*a* defining a downwardly open channel, and the lower L-shaped flange 14*a* defining an upwardly open channel. These vertically spaced channels in the back panel 10*a* are adapted to receive projecting portions of support means, either in the form of the support bracket of FIG. 5, or alternatively in the form of the utility boxes 70*a* and 70*c* to be described in greater detail hereinbelow with reference to FIGS. 6 and 7. Still with reference to FIG. 5 the top channel defining flange 12*a* of the back panel receives an upwardly projecting flange 42*a* defined in the support bracket and oriented generally perpendicularly with respect to the vertically extending web portion of the support bracket 30*a*.

Still with reference to the extruded back panel 10*a*, said member includes integrally formed forwardly projecting legs 16*b* and 18*b*, which legs extend the entire length of the extruded panel, and cooperate with one another to define a conduit channel therebetween. More particularly, the upper leg 16*b* includes a depending projection which defines a slot, which is aligned with a corresponding slot in the lower leg such that a cover plate 20*a* can be conveniently inserted with its marginal upper and lower edges slidably received in these slots. The closed conduit channel or wire-way so defined in adapted to house and protect the wiring used to control and power the elongated heating element indicated generally at E′ in FIG. 5.

A forwardly projecting bottom flange 22*a* is provided intermediate the lower L-shaped flange 14*a* and the lower leg 18*b* associated with the electrical conduit referred to in the previous paragraph. This bottom flange 22*a* is provided for conveniently mounting the support brackets 30*a* and also the utility boxes 70*a* and 70*c* to the back panel. Fastener means, in the form of a pop rivet, or sheet metal screw 48, may be utilized for this purpose. A bottom flange 40*a* on the support bracket 30*a* is provided for this fastener, and it is further noted that the web portion of the support bracket 30*a* has a rectangularly configured relieved portion 46*a* to permit the support bracket to be arranged as shown in FIG. 5 with suitable clearance being provided for the conduit defining channel leg 16*b* and the bottom flange 22*a* of the back panel. Still with reference to the extruded back panel 10*a* an upper flange 24*a* is also provided, immediately above the upper L-shaped flange 12*a*, and cooperates therewith to define a slot 26*a* well adapted to receive the rear edge of a vane grille defining portion 60*a* of a U-shaped front panel member 52 to be described. Thus, and as best shown in FIG. 6, the back panel member 10*a* is of extruded configuration having a cross sectional shape which is constant throughout its length, and certain features of this cross sectional shape comprise essential elements of the invention disclosed herein.

The support bracket 30*a* of FIG. 5 differs slightly from that described hereinabove with reference to FIG. 3, although both brackets do include vertically extending web portions oriented generally transversely with respect to the plane of the back panel. Further, the web portions of these support brackets define an upwardly open slot in which the finned heat exchange element is adapted to be received. However, the support bracket 30 of FIG. 5 is inclined slightly with respect to the plane of the back panel rather than being perpendicular thereto, and this angle is dictated by the helical configuration of the finned portion of the heat exchange element as best shown in FIG. 6. Further, and still with reference to the differences between the support bracket 30a of FIG. 5 includes a front flange 50*a* extending vertically of the web portion, except for a cut-out indicated generally at 35*a*. The purpose of the cut-out is to provide a convenient location for the insertion of a screw or the like, which screw 37 serves to directly connect the support bracket 30*a* to the fins of the exchange element. That is, the spacing between the fins is such that the screw 37 can be inserted between adjacent fins, or more particularly between one of the fins and the web on the support bracket 30*a* to anchor the heat exchange element to the support bracket. However, the weight of the heat exchange element will be supported by the bottom of the upwardly open slot 34*a* just as in the support bracket 30 described previously with reference to FIG. 3. The lower flange 40*a* of the support bracket 30*a* extends from front to rear thereof and includes a portion which is adapted to abut the bottom flange 22*a* on the back panel 10*a*. Thus, the support bracket 30*a* does not include a down-turned flange receivable in the upwardly open channel of the bottom L-shaped flange 14a of the back panel 10a. This lower channel is left open in order to receive a down-turned rear edge portion of the leg 50a of the generally U-shaped front panel member to be described.

FIG. 6 shows in exploded relationship the back panel member 10a, support means for supporting the elongated heating elements E', and the generally U-shaped extruded front panel member 52a. A single support bracket 30a is illustrated as supporting the elongated heating element E' generally at its midpoint, said heating element being support at its right hand end portion by the utility or junction box indicated generally at 70a. A left hand utility or junction box for support of the left hand end portion of the heating element E' is illustrated generally at 70c in FIG. 7. These boxes 70a and 70c like those described hereinabove with reference to the first embodiment provide a convenient receptacle for connecting the power supply lines and the thermostat control circuitry (not shown) through suitable openings defined for this purpose in the junction boxes with the heating element E' some of which conductors are housed in the conduit channel. It is an important feature of the present invention that each of these boxes 70a and 70c can be conveniently assembled with the associated back plate member 10a and each such box includes left and right hand side walls, 72a and 74a respectively, which side walls are under cut or relieved along their rear edges in order to accommodate the legs 16b, 18b as well as to accommodate the bottom flange 22a of the back plate member 10a.

Still with reference to the utility box 70a, illustrated in FIG. 6, said box is generally rectangular in configuration with an open rear side and an open front side, which sides are closed by the back plate member 10a and the front panel member 52a respectively. The top and bottom walls, 80a and 82a respectively, of the box 70a are integrally connected to the left and right hand side walls, 72a and 74a respectively, along at least one side edge thereof. More particularly, the box 70a may be fabricated from an initially flat piece of sheet metal or the like, with tabs 84a, 84a being provided adjacent the free edges at one of the four corners to be received in slots provided for this purpose in the top wall 80a. Thus, the initially flat sheet metal part is conveniently formed in the rectangular cnfiguration shown.

For convenient mounting of the box 70a to the back panel 10a the top wall 80a includes an upstanding rear flange 88a adapted to be received in the downwardly open cavity defined by the projecting generally L-shaped flange 12a in the back panel 10a. The marginal rear edge portion of the bottom wall 82a is adapted to abut the bottom flange 22a of the back panel member 10a and to be fastened thereto by a pop rivet or sheet metal screw such as indicated at 48 in FIG. 5 with reference to the support bracket 30a. Finally, and still with reference to the top wall 80a of the junction box 70a, and upstanding front flange 86a is provided for conveniently supporting the U-shaped front panel member 52a. A sheet metal screw 48 can be conveniently inserted through an opening in the upper leg of the U-shaped front panel 52a, as best shown in FIG. 6, to extend outwardly behind this front flange 86a in order to secure thr front panel member 52a in the position indicated for it by the broken lines in FIG. 6.

Turning next to a more detailed description of the front or cover panel 52a, said member preferably comprises an aluminum extrusion of generally U-shaped cross section having an upper inwardly extending leg 60a which defines the grille openings and vanes for directing the heated air upwardly into the room to be heated. The extrusion permits the vanes 60b to be readily fabricated, and the openings are stamped out of the flat portion intermediate the vanes as indicated generally at 60c. The inner edge of the horizontally extending leg 60a is adapted to be received in the slot defined between the uppermost flange 24a of the back panel in conjunction with the top portion of the L-shaped flange 12a of said back panel. Preferably, the L-shaped flange comprises a generally T-shaped configuration as best shown in FIG. 6 so as to facilitate receiving this inner marginal edge of the horizontally extending grille defining member 60a.

The previously described embodiment disclosed a front panel member 52 which had a lower edge adapted to being mounted to the support means directly rather than being tied into the back panel itself. In the embodiment illustrted in FIG. 6, on the other hand, the front panel 52a includes a lower leg 62a oriented horizontally and parallel the upper leg 60a of the U-shaped extrusion, and it is a feature of the alternative embodiment of the present invention that the inner marginal edge of this lower leg 62a defines a down-turned flange adapted to be received in the upwardly open channel defined by a lower L-shaped flange 14a on the back panel 10a. This bottom leg portion 62a is also stamped to provide openings, as indicated generally at 62c, in order to facilitate the passage of air upwardly past the heating element E' and thence further upwardly and outwardly between the vanes and through the above mentioned openings 60c associated with the upper leg 60a of the front panel 52a.

I claim:

1. Apparatus for supporting and housing an elongated heat exchange element, said apparatus comprising an elongated back panel member with a rear face adapted to abut a vertical wall and a front face defining upper and lower integrally formed L-shaped flanges projecting forwardly from and extending the entire length of said back panel member to define vertically spaced channels, at least one support bracket having a vertically extending web oriented transversely with respect to said back panel member, said web provided with an upwardly open slot to receive and support an elongated heat exchange element, said bracket further including upper and lower flanges projecting generally perpendicularly from said web and defining vertically spaced projections, said projections slidably received in said vertically spaced channels of said back panel member, and said back panel member further including forwardly projecting legs also extending the entire length of said panel member and defining a conduit channel therebetween, a cover plate supported by said legs, and said support bracket web being relieved along its rear edges between said upper and lower flanges to accommodate said conduit channel defining legs and cover plate.

2. The combination defined in claim 1 wherein said lower flange of said support bracket is oriented horizontally, and defines said lower projection at the rear edge of said lower flange, said lower projection being oriented perpendicular to said lower flange, and a lower front projection depending opposite said rear lower projection in said lower flange, and a front panel member with an L-shaped rearwardly projecting flange extending longitudinally along its lower marginal edge, said L-shaped flange on said front panel member defining a channel for receiving said depending front flange projection of said support brackets, and fastener means for attaching the upper marginal edge of said front panel to the forward edge of said support bracket web.

3. The combination defined in claim 2 above and further characterized by a utility box comprising a four sided rectangular structure having left and right side walls which are vertically oriented and a top and a bottom wall integrally connected to said left and right side walls, said top and bottom walls including upper and lower flanges integrally formed along rear edges respectively of said top and bottom walls, said upper and lower flanges slidably received in said channels defined by said L-shaped flanges on said rear panel member, said left and right hand side walls of said box structure being relieved along respective rear edges thereof to accommodate said conduit channel defining legs of said rear panel member.

4. The combination defined in claim 3 above wherein said back panel member further includes a forwardly projecting bottom flange integrally formed in said back panel member and extending the entire length thereof generally between said lower conduit defining channel leg and said lower L-shaped flange, said relieved rear edges of said bracket webs and said utility box side walls being relieved to accommodate said bottom flange, and said bottom flange providing an abutment for said utility box bottom wall.

5. The combination defined in claim 4 further characterized by a grille member for said apparatus, said front panel having a rearwardly projecting upper flange extending longitudinally thereof, said rear panel upper flange and said front panel upper flange supporting said grille member, and at least one fastener extending through said grille member and through said upper flange on said front panel and anchored to one of said support brackets.

6. Apparatus for supporting and housing an elongated heat exchange element, said apparatus comprising an elongated back panel member with a rear face adapted to abut a vertical wall and a front face defining upper and lower integrally formed L-shaped flanges projecting forwardly from and extending the entire length of said panel member to define vertically spaced channels, forwardly projecting legs defined integrally of said panel member and also extending its entire length to define a conduit channel therebetween, a cover plate supported by said legs, a utility box of generally rectangular shape having left and right hand side walls which are vertically oriented and top and bottom walls connected to said left and right hand side walls, said top wall including an upstanding flange along its rear edge receivable in said upper channel, and said side walls of said box being relieved to accommodate said conduit channel legs and said cover plate.

7. The combination defined in claim 6 further characterized by a generally U-shaped elongated front panel member, said front panel member having a generally horizontally extending upper leg portion defining grille openings and a lower leg portion of said front panel member also having openings, and a depending flange extending along the rear edge of said lower leg portion and receivable in said lower channel of said back panel member.

8. The combination defined in claim 7 wherein said back panel member further includes a forwardly projecting upper flange integrally formed in said back panel member and extending the entire length thereof and spaced above said upper L-shaped flange to define a forwardly open slot therebetween, and said upper leg portion of said U-shaped front panel having its rear marginal edge received in said slot.

9. The combination defined in claim 8 wherein said back panel member further includes a forwardly projecting bottom flange integrally formed in said back panel member and extending the entire length thereof generally between said lower conduit channel defining leg and said lower L-shaped flange, having slots and fasteners for attaching the bottom wall of said utility box to said bottom flange.

10. The combination defined in claim 9 further characterized by a support bracket having a vertically extending web oriented transversely with respect to said panel member, said web having an upwardly open slot to receive and support an elongated heat exchange element, said bracket further including upper and lower front flanges projecting generally perpendicularly from said web, said upper flange of said bracket being received in said upper channel of said back panel member, and said lower flange of said bracket being adjacent said back panel bottom flange, and fasteners for attaching said lower bracket flange to said back panel bottom flange.

11. Apparatus for supporting and housing an elongated heat exchange element, said apparatus comprising:

(a) an elongated back panel extrusion having a rear face adapted to abut a generally vertical wall and a front face defining:
  (1) an upper integrally formed L-shaped flange projecting forwardly from and extending the entire length of said back panel member to define a downwardly open upper channel,
  (2) a lower integrally formed L-shaped flange projecting forwardly from and extending the entire length of said back panel member to define and upwardly open lower channel,
  (3) vertically spaced forwardly projecting legs formed integrally of said back panel member and defining a conduit channel therebetween, and
  (4) a forwardly projecting bottom flange above said lower L-shaped flange,
(b) a cover plate supported by said conduit channel legs,
(c) support means for receiving an elongated heating element, said support means including:
  (1) a vertically extending side wall adapted for attachment to the heating element,
  (2) an upwardly projecting rear flange oriented generally perpendicularly with respect to said side wall and received in said upper channel,
  (3) a lower flange oriented generally perpendicularly with respect to said side wall and abutting said bottom flange of said back panel, and
  (4) an upwardly projecting front flange,
(d) fastener means for attaching said bottom flange of said back panel to said lower flange of said support means,
(e) a front panel having a rearwardly projecting upper flange abutting said front flange of said support means, and
(f) fastener means for connecting said front panel upper flange to said front flange of said support means.

* * * * *